United States Patent [19]

Heers

[11] 4,329,906

[45] May 18, 1982

[54] RELOADING APPARATUS HAVING IMPROVED PRIMER MECHANISM

[75] Inventor: Edward A. Heers, Grand Island, Nebr.

[73] Assignee: Hornady Manufacturing Company, Grand Island, Nebr.

[21] Appl. No.: 150,802

[22] Filed: May 19, 1980

[51] Int. Cl.[3] ..... F42B 33/10

[52] U.S. Cl. ..... 86/36; 86/23

[58] Field of Search ..... 86/23, 32, 36, 44

[56] References Cited

U.S. PATENT DOCUMENTS

| | | | |
|---|---|---|---|
| 3,313,201 | 4/1967 | Lawrence | 86/32 |
| 3,319,511 | 5/1967 | McLean | 86/44 |
| 4,188,855 | 2/1980 | Alberts | 86/23 |
| 4,202,245 | 5/1980 | McSpadden | 86/23 |

*Primary Examiner*—Leland A. Sebastian

*Attorney, Agent, or Firm*—Vincent L. Carney

[57] ABSTRACT

A reloading apparatus removes used primer caps and inserts new primer caps into the base of casings substantially automatically. The apparatus includes a ram for holding a casing and for moving the casing relative to a reconditioning means for reconfiguring the casing to a desired, predetermined configuration. The ram carries a primer arm movable automatically between a first, non-priming position during the time the casing is being deprimed and a second, priming position after the casing has been deprimed. The ram is provided with a longitudinally extending slot having a pivot pin. The primer arm includes a first member disposed within the slot and releasably connected to the pivot pin. The primer arm includes a second member extending outwardly of the slot and engageable with a stationary portion of the reloader. A primer cap holder is located at the intersection of the first and second members. Upon movement of the ram toward the priming position, the second member engages the stationary portion and causes the primer cap holder to be pivoted into the ram slot. Further movement of the ram toward the priming position causes the primer arm to move relative to the ram and the casing and a primer cap eventually is pressed into the base of the casing. Upon movement of the ram to the non-priming position, the weight of the primer arm causes the primer arm to pivot about the pivot pin and move out of the slot. A new primer cap then can be inserted into the primer cap holder for use in a subsequent priming operation.

17 Claims, 6 Drawing Figures

RELOADING APPARATUS HAVING IMPROVED PRIMER MECHANISM

BACKGROUND OF THE INVENTION

1. Field of the Invention

The present invention relates to reloading apparatus and, more particularly, to a reloading apparatus having an improved primer mechanism by which a priming operation can be carried out substantially automatically.

2. Description of the Prior Art

In one class of reloading apparatus, a used shotgun shell or metallic cartridge is reconditioned by pressing a casing of the shell or cartridge into a steel die which forces the casing into a desired, predetermined configuration. At the same time, a pin engages a used primer cap carried in the base of the casing and forces the cap out of the casing. The casing is then ready to be reprimed and thereafter loaded with powder, appropriate wads, and shot or a bullet.

Particularly in the case of metallic cartridges, a reconditioning means in the form of a steel die is held in a stationary position atop a press frame. The die is hollow and its inner surface is shaped precisely to the desired exterior configuration of that caliber of cartridge being reloaded. The press includes a vertically movable ram. The ram includes at its upper end a holder head for grasping the base of a casing to be reloaded. Upon moving a handle, a linkage connected to the ram moves the ram and the attached casing upwardly into the steel die for reconfiguration. A pin centered within the die eventually is contacted by the spent primer cap carried by the base of the casing. Upon sufficient displacement of the casing into the die, the pin presses the primer cap out of the casing.

After the casing has been reshaped and deprimed, it is necessary to insert a new primer cap into the casing. In a known reloading apparatus, a new primer cap is inserted into a reconditioned casing by a so-called primer arm. The primer arm is pivotally mounted to the reloader at a location adjacent the ram. The primer arm includes a primer cap holder located at its upper end. The ram includes a vertically extending slot opening through to the base of the casing. Upon loading a primer cap into the primer cap holder and pivoting the primer arm into the slot, the ram can be moved downwardly, thereby causing relative motion between the base of the casing and the primer cap holder. Eventually, the primer cap is pressed into the casing and seated in position there.

Although the aforementioned priming technique functions effectively, certain problems have not been addressed. One of these problems relates to the manual nature of the priming operation. In the referenced system, the primer arm is spring-biased to a non-priming position. Accordingly, when it is desired to insert a new primer cap into a casing the operator must manually urge the primer arm into priming position against the spring bias. Not only must the priming arm be moved at the proper time during the reloading cycle, but it must be pushed to the proper position within the slot in order for the primer cap and the casing to be properly aligned. Desirably, the primer arm would be movable automatically into priming position at the proper time during the reloading cycle without any operator assistance being required. This would increase the speed and effectiveness of the reloading operation, as well as making it easier for a reloading operation to be carried out.

Another problem relates to difficulties in mounting a new primer cap into the primer cap holder. It would be desirable for a new primer cap to be inserted into the primer cap holder automatically at an appropriate point during the reloading cycle. Such an automatic primer cap feed feature would increase the speed and effectiveness of the reloading operation.

In carrying out the foregoing objectives, it is important that the primer apparatus be formed with a minimum of machining and attention to close tolerences. Desirably, the apparatus also would be easy to disassemble for cleaning and inspection. Prior reloading apparatus has not been entirely satisfactory as regards these considerations.

Accordingly, it is an object of this invention to provide a novel reloading apparatus.

It is a still further object of this invention to provide a priming mechanism for a reloading apparatus which substantially automatically inserts a new primer cap into a casing.

It is a still further object of this invention to provide a primer mechanism for a reloading apparatus which functions automatically to be loaded with new primer caps and thereafter to load casings with new primer caps.

It is a still further object of the invention to provide novel reloading apparatus that is economical to manufacture and which can be disassembled readily for inspection and cleaning.

SUMMARY OF THE INVENTION

In accordance with the above and further objects of the invention, the reloading apparatus according to the invention includes a reconditioning means in the form of a die into which the casing of a shell or cartridge can be inserted for reconfiguring. A vertically movable ram includes a holder head for holding the casing as the casing is moved into and out of the die. As the casing approaches a seated position within the die, a pin carried by the die engages a used primer cap in the base of the casing and presses the primer cap out of the casing.

A primer mechanism includes a primer arm carried by the ram and movable with the ram. A lost motion connection between the primer arm and the ram permits the primer arm to move relative to the ram at an appropriate point during the reloading cycle. A longitudinal slot is provided in the ram, the slot extending from a first location adjacent the casing holder head to a second location remote from the casing holder head. A pivot pin spans the slot near the second location. The primer arm includes a first member connected to the pivot pin, a second member which extends outwardly of the slot, and a primer cap holder located at the intersection between the first and second members. Upon downward movement of the ram, the second member contacts a stationary portion of the reloading apparatus, thereby causing the primer arm to pivot about the pivot pin and into the slot. Continued downward movement of the ram causes the primer arm to move relative to the ram and the casing and disengage the pivot pin. Eventually, the primer cap carried by a primer cap holder is forced into the base of the casing.

Upon subsequent upward movement of the ram, the primer arm moves relative to the ram and re-engages the pivot pin. Additional upward movement of the ram causes the primer arm to pivot with respect to the pin and move out of the slot. Yet additional upward movement of the ram causes engagement between the primer cap holder and an automatic primer cap feeding apparatus.

DESCRIPTION OF THE PREFERRED EMBODIMENT

Figure 1:
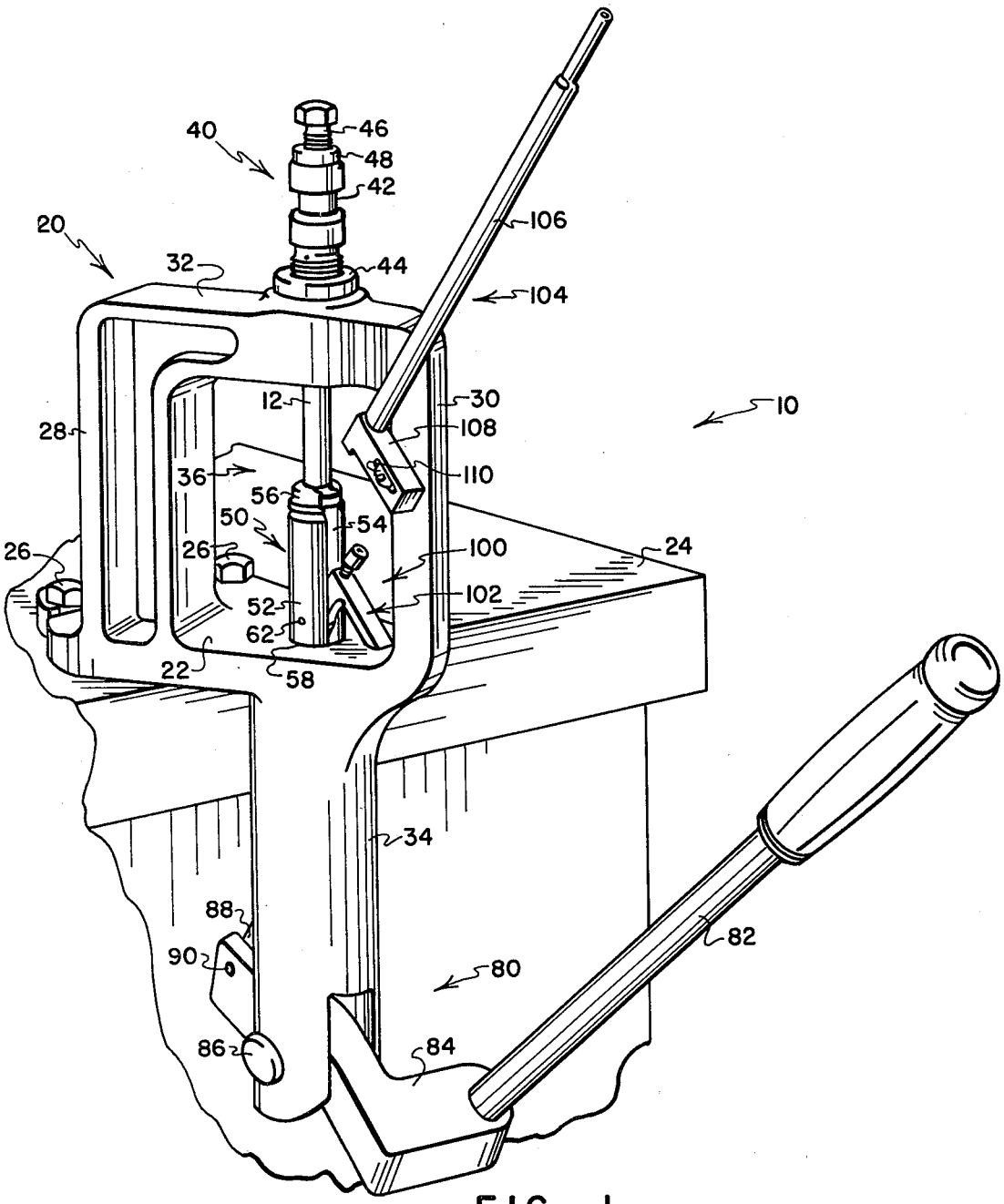
FIG. 1 is a perspective view of a reloading apparatus according to the invention particularly suitable for reloading metallic cartridges.
Figure 2:
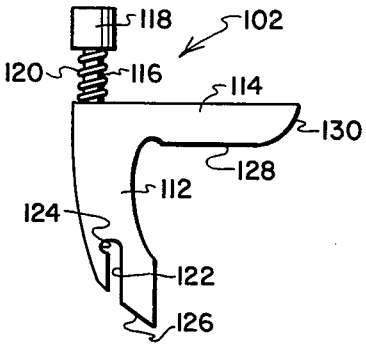
FIG. 2 is a side elevational view of a primer arm according to the invention.

In FIG. 1 there is shown a perspective view of a a reloading apparatus 10 according to the invention having a frame 20, a reconditioning means 40, a ram 50, a drive means 80, and a primer mechanism 100. A metallic cartridge casing 12 is shown in the process of being reloaded. While a metallic cartridge reloader 10 is described in the description of the preferred embodiment herein, the invention obviously can be used with other types of reloading equipment such as shotshell reloaders and the like.

The reloading apparatus 10 carries out several functions. Operating upon the spent cartridge casing 12, the reloading apparatus 10 reconfigures the casing 12 to a desired, predetermined configuration. In the particular case of a metallic cartridge, the reconditioning means 30 not only resizes the casing, but also removes a spent primer cap from the base of the casing and expands the neck of the casing. Thereafter, a new primer cap is inserted into the base of the casing, a charge of powder is deposited within the casing, a bullet is seated in the neck of the casing, and the mouth of the casing is crimped to tightly engage the bullet. The apparatus 10 shown in FIG. 1 is a so-called single station, nonprogressive reloading tool in that all of the foregoing operations are carried out at the same place by successive operation of the same apparatus.

The frame 20 includes a generally horizontally disposed flat base 22 secured to a tabletop 24 by means of fasteners 26. Legs 28, 30 extend vertically from the base 22 and are connected at their upper ends by a brace 32. The base 22 extends outwardly of the tabletop 24 and a column 34 extends downwardly from the underside of the base 22. Taken together, the base 22, the legs 28, 30, and the brace 32 define an opening 36. Viewed from above, the legs 28, 30 and the brace 32 are angled approximately 30° to one side in order to provide easier access to the opening 36.

The reconditioning means 40 is in the form of a steel die 42 as is well known in the art. The die 42 is threaded into an opening formed in the brace 32. The die is secured in place by a lock ring 44. The die 42 is hollow and includes a concentrically disposed spindle 46 threaded into the upper end of the die 42. The spindle 46 is held in an opening formed in the brace 32. The die is secured in place by a lock ring 44. The die 42 is hollow and includes a concentrically disposed spindle 46 threaded into the upper end of the die 42. The spindle 46 is held in place by a lock ring 48. The die 42 is configured on its inner surface such that, upon forcing a casing into the die 42, the casing will be formed into a desired, predetermined configuration. The spindle 46 includes a pin (not shown) projecting the length of the die 42 and engageable with a used primer cap. Upon displacing a casing sufficiently far into the die 42, the pin will contact the primer cap and force the primer cap from the base of the casing. The die 42 can be replaced by other dies for carrying out other operations on the casing after the casing has been resized and deprimed. For example, in a two-die set, a second die would seat a bullet and crimp the mouth of the casing tightly against the bullet. In a three-die set, the die 42 would only resize the casing, while a second die would deprime the casing and expand the neck, and a third die would seat the bullet and crimp the mouth of the casing. As indicated previously, dies suitable for performing various operations on casings are well known in the art and do not form a part of the present invention.

The ram 50 is a generally cylindrical, vertically movable member to which casings can be removably secured at the upper end. The ram 50 includes an elongate portion 52, an elongate, longitudinally extending slot 54, and a holder head 56 secured to the elongate portion 52 at the upper end of the elongate portion 52. The elongate portion 52 is movable vertically in an opening 58 formed in the base 22. The slot 54 extends from a first location adjacent the holder head 56 to a second location remote from the holder head 56. A pivot pin 60 (FIGS. 3–6) spans the slot 54 near the second location. The pin is insertable through an opening 62 formed in the side of the elongate portion 52. Referring again to FIGS. 3–6, the slot includes a curved lower portion 64 smoothly connected to a vertical wall 66 of the slot 54.

The holder head 56 is secured atop the elongate portion 52 and includes a laterally extending slot 68 having undercut portions 70. The width of the slot 68 and the extent of the undercut portions 70 is a function of the size of the casing being reloaded. A vertically extending opening 72 is formed in the head 56. The opening 72 extends completely through the head 56 and thus provides communication between the slots 54, 68.

The drive means 80 includes a handle 82, a rocker arm 84 secured to the lowermost portion of the column 34 by means of a pin 86, and a link 88. The link 88 is connected at its upper end to the lowermost portion of the ram 50, while the lower portion of the link 88 is connected to the rocker arm 84 by a pin 90. Upon moving the handle 82 up and down, the rocker arm 84 will be pivoted such that the link 88 will be reciprocated vertically. In turn, the ram 50 will be reciprocated vertically. If a casing is secured in place atop the ram 50, the casing also will be reciprocated vertically into and out of the die 42. Depending upon the internal configuration of the die 42, desired operations will be carried out on the casing.

The primer mechanism 100 is a feature of the invention and permits casings to be supplied with new primer caps substantially automatically. The primer mechanism 100 includes a primer arm 102 carried by the ram 50 and movable with the ram 50. The primer mechanism 100 also includes a primer feed 104 for automatically supplying primer caps to the primer arm 102. The primer feed 104 consists of a primer feed tube 106 and a feed block 108 secured to the leg 30 by means of a fastener 110.

Referring particularly to FIGS. 2–6, the primer arm 102 includes a first member 112 and a second member 114 positioned substantially at right angles to each other. A primer seating punch 116 is secured to the primer arm 102 near the interface between the first and second members 112, 114. The primer seating punch 116 is stationary and extends along an axis generally parallel with the longitudinal axis of the first member 112. The primer seating punch 116 includes an enlarged head (not shown) engagable with a primer cap to force the primer cap into a casing at an appropriate point in the reloading cycle. A primer cap holder 118 is disposed about the primer seating punch 116 and is movable axially therealong. The primer cap holder 118 includes a hollowed portion suitable for carrying primer caps. Axial movement of the primer cap holder 118 is limited by the enlarged portion of the primer seating punch 116. A spring 120 biases the primer cap holder 118 toward engagement with the enlarged portion of the primer seating punch 116.

The first member 112 includes a longitudinally extending slot 122 having a laterally extending offset 124 at its innermost end. The slot 122 and the offset 124 are engagable with the pivot pin 60. When the first member 112 is placed in the slot 54 aligned with the longitudinal axis of the ram 50, a lost motion connection between the primer arm 102 and the ram 50 permits the primer arm 102 to move relative to the ram 50. When the pivot pin 60 engages the offset 124, the primer arm 102 can be pivoted about the pin 60 and relative longitudinal movement between the primer arm 102 and the ram 50 no longer is possibe.

The end of the first member 112 terminates in a generally flat end surface 126. When the pivot pin 60 engages the offset 124 and the primer arm 102 is pivoted clockwise as viewed in the FIGURES, the end surface 126 eventually engages the curved lower portion 64, thereby limiting the pivotal movement of the primer arm 102. The second member 114 includes a longitudinally extending flat surface 128 and a smoothly contoured transition end surface 130.

Operation

In order to reload a number of cartridge casings 12 using the reloader 10 according to the invention, a properly sized die 42 is secured atop the brace 32 and locked in place by the lock rings 44. A holder head 56 of a size suitable to accept casings being processed is snapped in place atop the elongate member 52. The primer feed 104 is secured to the leg 30 and is adjusted such that the primer cap holder 118 engages the feed back 108 at the extreme upstroke of the ram 50. After the foregoing elements have been attached to the reloader 10, after a number of primer caps have been inserted into the primer feed tube 106, and after a casing 12 has been secured to the holder head 56, a reloading operation is ready to be carried out.

Figure 3:
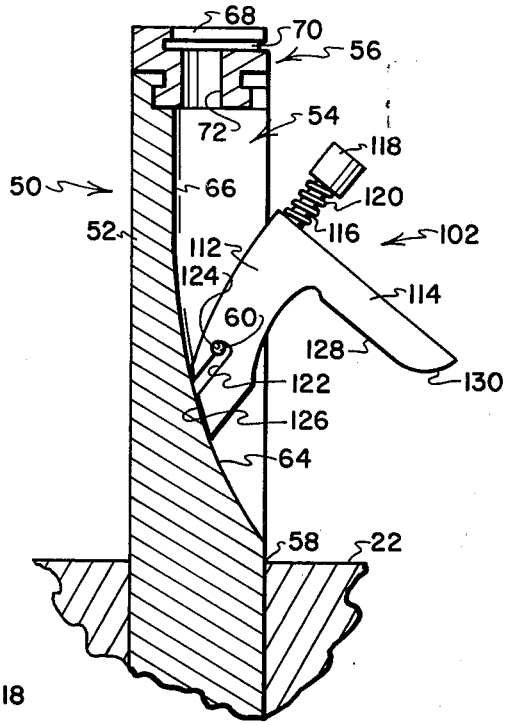
FIG. 3 is a view, partly in section, of the primer arm according to the invention installed in place within a ram; and, FIGS. 4, 5, and 6 are views similar to FIG. 3 showing the ram and primer arm during various stages of a reloading operation.
Figure 4:
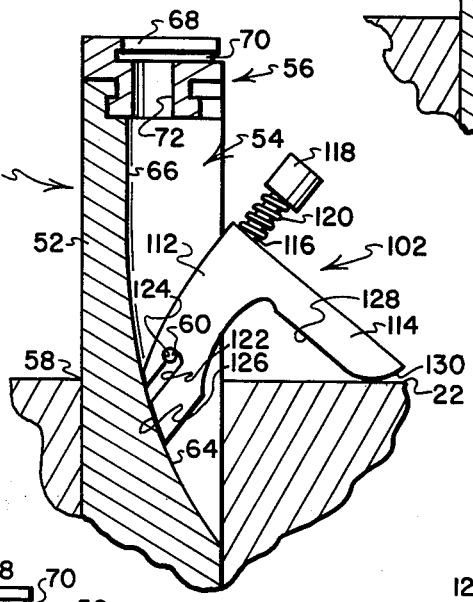
Figure 5:
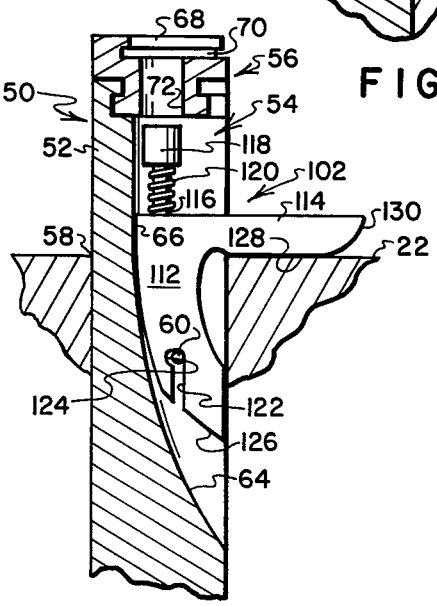
Figure 6:
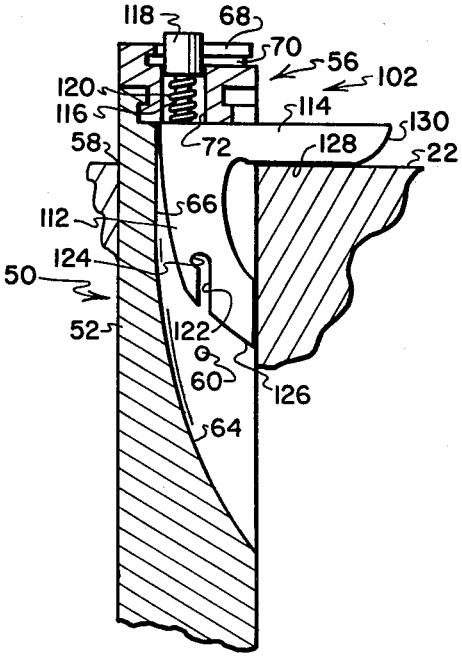

Referring to FIG. 3, it will be assumed that the ram 50 is in the uppermost position, that a used primer cap has been pressed from the base of the casing, and that a new primer cap has been dropped into the primer cap holder 118. At this point, the exterior configuration of the casing 12 will have been forced into a desired, predetermined configuration due to contact with the internal surfaces of the die 42. Upon raising the handle 82, the rocker arm 84 will be pivoted and the ram 50 will be moved vertically downwardly. Upon continued movement of the handle 82, eventually the contoured transition surface 130 contacts the flat base 22 (FIG. 4). Because the pivot pin 60 is in engagement with the offset 124, counterclockwise pivoting of the primer arm 102 about the pivot pin 60 occurs upon further vertically downward movement of the ram 50. Eventually that position illustrated in FIG. 5 will be attained, where the flat surface 128 is in contact with the flat base 22 and the pivot pin 60 has shifted position with respect to the offset 124 such that the pivot pin 60 is vertically aligned with the slot 122.

Continued downward movement of the ram 50 results in relative longitudinal movement between the primer arm 102 and the ram 50. Because the longitudinal axis of the primer seating punch 116 is substantially at right angles to the longitudinal axis of the second member 114, and further because the flat base 22 lies in a horizontal plane, the primer seating punch 116 is vertically oriented. The primer arm 102 is sized appropriately such that the primer cap holder 118 is vertically aligned with the opening 72 when the surface 128 is in firm engagement with the flat base 22. Accordingly, upon additional downward displacement of the ram 50 from that position illustrated in FIG. 5 to that position illustrated in FIG. 6, the primer cap holder 118 will pass through the opening 72 and into the slot 66. With a casing 12 in position within the holder head 56, the primer cap holder 118 will contact the base of the casing 12 and be moved relative to the primer arm 102 against the bias exerted by the spring 120. Because the primer seating punch 116 is stationary with respect to the primer arm 102, continued displacement of the primer arm 102 toward the casing 12 will result in the primer seating punch 116 pressing the primer cap held by the primer cap holder 118 firmly into the base of the casing 12. At this point, the ram 50 is at its extreme lowermost position.

As the handle 82 is moved downwardly (thereby moving the ram 50 vertically upwardly), the movement of the primer arm 102 essentially is the reverse of that already described. Because the pivot pin 60 is aligned with the slot 122, vertically downward movement of the primer arm 102 results in re-engagement between the pivot pin 60 and the slot 122. Eventually, the pin 60 and the offset 124 re-engage each other, and upon additional vertically upward movement of the ram 50, the primer arm 102 will be pivoted clockwise under the influence of gravity to that position shown in FIG. 4. The extent of pivotal movement of the primer arm 102 will be limited by engagement of the end surface 126 with the curved portion 64.

It will be appreciated that the method and apparatus according to the invention permits casings to be deprimed and primed substantially automatically. Because the primer arm 102 travels with the ram 50, the motion of the ram 50 can be used to advantage to activate the primer mechanism 100. The primer arm 102 can be manufactured relatively quickly and inexpensively, without concern for close manufacturing tolerances. Because the primer arm 102 can be readily disengaged from the pivot pin 60, the primer arm 102 can be removed from the ram 50 for convenient cleaning and/or inspection.

Although a preferred embodiment of the invention has been described with some particularity, many variations and modifications in the preferred embodiment may be made without deviating from the invention. Accordingly, it is to be understood that, within the scope of the appended claims, the invention may be practiced otherwise than as specifically described.

What is claimed is:

1. Reloading apparatus for holding a casing and inserting a primer cap into the base of the casing, comprising:

an elongate ram movable vertically between an uppermost position and a lowermost position, the ram including means by which the base of a casing may be secured to the ram and maintained stationary with respect to the ram;

the ram including an opening to provide communication with the base of a casing secured to the ram;

a primer arm for carrying a primer cap and inserting the primer cap into the base of a casing by the ram, the primer arm being connected to the ram and moving with the ram for at least a portion of the travel of the ram, the primer arm including:

a first member connectable with the ram, the connection permitting the primer arm to move from a non-priming position where a primer cap may be inserted into the primer arm to a priming position where a primer cap may be inserted through the opening in the ram into the base of a casing; and a second member for moving the primer arm into priming position and for disengaging the connection between the priming arm and the ram whereby, upon movement of the ram, the priming arm moves relative to the ram and inserts a primer cap into the base of a casing secured to the ram.

2. Reloading apparatus according to claim 1, wherein:

the ram opening is in the form of a longitudinally extending slot extending from a first location adjacent that end of the ram to which the casing is secured to a second location removed from the first location;

a pivot pin extends across the slot near the second location;

the primer arm first member extends into the slot and is selectively engagable with the pivot pin;

the primer arm second member extends outwardly of the slot and defines surfaces for initiating displacement of the primer arm toward the priming position and for engaging a stationary portion of the reloading apparatus as the primer arm attains the priming position, thereby causing relative motion between the primer arm and the ram.

3. Reloading apparatus according to claim 2, further comprising a lost motion connection between the pivot pin and the first member, the lost motion connection permitting the primer arm to move longitudinally of the ram as the ram approaches the lowermost position and permitting the pivotal connection between the primer arm and the pivot pin to be re-established as the ram is moved toward the uppermost position.

4. Reloading apparatus according to claim 3, wherein the lost motion connection is provided by:

a slot extending longitudinally of the first member, the slot opening through an end surface of the first member;

a laterally extending offset provided at that end of the slot remote from the end surface; and the slot and offset being of a width sufficient to accomodate the pivot pin.

5. Reloading apparatus according to claim 1, further comprising a primer feed for supplying primer caps to the primer arm as the ram approaches the uppermost position.

6. Reloading apparatus according to claim 5, wherein the primer feed comprises:

an elongate feed tube for holding a supply of primer caps; and a feed block to which the primer feed tube is secured, the feed block being positioned such that the primer arm engages the feed block, thereby dispensing primer caps into the primer arm.

7. Reloading apparatus for holding a casing and inserting a primer cap into the base of the casing, comprising:

an elongate ram movable vertically between an uppermost position and a lowermost position, the ram including a holder head by which the base of a casing may be secured to the ram and maintained stationary with respect to the ram;

the ram having a longitudinally extending slot extending from a first location adjacent the holder head to a second location remote from the holder head;

the holder head being provided with an opening to establish communication between the base of a casing carried by the holder head and the slot;

a pivot pin extending across the slot near the second location;

a primer arm for carrying a primer cap and inserting the primer cap into the base of a casing carried by the holder head, the primer arm including:

a first member extending into the slot and engagable with the pivot pin, the engagement with the pivot pin permitting the primer arm to pivot from a non-priming position outside of the slot where a primer cap may be inserted into the primer arm to a priming position inside the slot where a primer cap can be inserted into the casing through the opening in the holder head; and a second member extending outwardly of the slot and having surfaces for initiating displacement of the primer arm toward the primary position and for engaging a stationary portion of the reloading apparatus as the primer arm attains the priming position.

8. Reloading apparatus according to claim 7, further comprising a lost motion connection between the pivot pin and the primer arm, the lost motion connection permitting the primer arm to move longitudinally of the ram as the ram approaches the lowermost position and permitting the pivotal connection between the primer arm and the pivot pin to be re-established as the ram is moved toward the uppermost position.

9. Reloading apparatus according to claim 8, wherein the lost motion connection is provided by:

a slot extending longitudinally of the first member, the slot opening through an end surface of the first member;

a laterally extending offset provided at that end of the slot remote from the end surface; and the slot and offset being of a width sufficient to accommodate the pivot pin.

10. Reloading apparatus according to claim 7, further comprising a primer feed for supplying primer caps to the primer arm as the ram approaches the uppermost position.

11. Reloading apparatus according to claim 10, wherein the primer feed comprises:

an elongate feed tube for holding a supply of primer caps; and a feed block to which the primer feed tube is secured, the feed block being positioned such that the primer arm engages the feed block, thereby dispensing primer caps into the primer arm.

12. Reloading apparatus for reconditioning a used casing, removing a spent primer from the casing, and inserting a new primer into the casing, comprising:

reconditioning means for altering the configuration of a casing to a desired, predetermined configuration;

a ram for holding a casing to be reconditioned;

drive means for moving the ram and the casing relative to the reconditioning means to effect reconditioning of the casing, the reconditioning means also removing a spent primer for the casing if a primer is carried by the casing; and a primer arm for inserting a primer cap into the casing, the primer arm being connected to the ram and movable with the ram, the primer arm being moved to a non-priming position during reconditioning of the casing and being moved to a priming position upon movement of the ram subsequent to reconditioning of the casing.

13. Reloading apparatus according to claim 12 in which the reconditioning means is stationary and the ram moves relative to the reconditioning means.

14. Reloading apparatus according to claim 13 in which:

the ram is an elongate member having a longitudinally extending slot, the slot extending from a first position adjacent that end of the ram to which the casing is secured to a second location remote from the first location;

a pivot pin extends across the slot near the second location;

a portion of the primer mechanism extends into the slot and is held in position there by the pivot pin; and, the primer mechanism is movable between the non-priming position where portions of the primer mechanism are positioned outside of the slot and the priming position where portions of the priming mechanism are moved into the slot.

15. Reloading apparatus according to claim 14, in which:

the primer arm is an L-shaped structure having first and second members positioned substantially at right angles to each other;

a slot is formed in the first member, the slot extending from the end of the first member along the longitudinal axis of the first member toward the juncture of the first and second members, the first member being insertable into the ram slot and the primer arm slot being engageable with the pivot pin;

a primer cap holder for receiving individual primer caps is carried by the primer arm and is located near the juncture of the first and second members; and, exterior surface portions of the second member constitute stop surfaces engageable with stationary portions of the reloading apparatus, engagement between the stop surfaces and the stationary portions of the reloading apparatus resulting in pivotal movement of the primer arm into the priming position and displacement of the primer cap holder into engagement with the base of the casing.

16. Reloading apparatus according to claim 13, further comprising a primer feed for supplying primer caps to the primer arm as the primer arm approaches the non-priming position.

17. Reloading apparatus according to claim 16, wherein the primer feed comprises:

an elongate feed tube for holding a supply of primer caps; and a feed block to which the primer feed tube is secured, the feed block being positioned such that the primer arm engages the feed block, thereby dispensing primer caps into the primer arm.

* * * * *

UNITED STATES PATENT AND TRADEMARK OFFICE

CERTIFICATE OF CORRECTION

PATENT NO. : 4,329,906

DATED : May 18, 1982

INVENTOR(S) : Edward A. Heers

It is certified that error appears in the above—identified patent and that said Letters Patent is hereby corrected as shown below:

Column 2, line 12, change "tolerences" to -- tolerances --.

Column 3, line 21, delete the second occurrence of "a".

Column 5, line 45, change "rings" to --ring--.

Column 5, line 49, change "back" to --block--.

Column 7, line 12, after "casing", insert "carried".

Column 7, line 38, after ";", insert "and".

Signed and Sealed this

*Twenty-sixth* Day of *October 1982*

[SEAL]

*Attest:*

GERALD J. MOSSINGHOFF

*Attesting Officer*

*Commissioner of Patents and Trademarks*